US008067715B2

(12) United States Patent
Peterson et al.

(10) Patent No.: US 8,067,715 B2
(45) Date of Patent: Nov. 29, 2011

(54) HEATED CONSTRUCTION BOX

(75) Inventors: Briston Peterson, Aspen, CO (US); Ronnie Bryant, Aspen, CO (US)

(73) Assignee: HotBoxx LLC, Snowmass, CO (US)

( * ) Notice: Subject to any disclaimer, the term of this patent is extended or adjusted under 35 U.S.C. 154(b) by 1332 days.

(21) Appl. No.: 11/668,223

(22) Filed: Jan. 29, 2007

(65) Prior Publication Data

US 2007/0193999 A1 Aug. 23, 2007

Related U.S. Application Data

(63) Continuation-in-part of application No. 11/024,633, filed on Dec. 29, 2004, now Pat. No. 7,170,035, which is a continuation-in-part of application No. 10/911,000, filed on Aug. 4, 2004, now Pat. No. 7,208,700.

(51) Int. Cl.
*A47B 81/00* (2006.01)
*B65D 81/18* (2006.01)
*F27D 11/02* (2006.01)

(52) U.S. Cl. ..... 219/386; 219/201; 219/209; 219/217; 219/401; 206/373

(58) Field of Classification Search ..... None
See application file for complete search history.

(56) References Cited

U.S. PATENT DOCUMENTS 1,659,719 A * 2/1928 Blake ..... 219/385
3,454,317 A * 7/1969 Harry ..... 312/21
3,752,373 A * 8/1973 Smith ..... 223/51
3,943,842 A * 3/1976 Bills et al. ..... 99/473
4,733,898 A * 3/1988 Williams ..... 296/24.32
4,924,072 A * 5/1990 Oslin ..... 219/401
4,991,912 A * 2/1991 Fox ..... 312/236
5,013,055 A * 5/1991 Labrum ..... 280/47.19
5,069,273 A * 12/1991 O'Hearne ..... 219/386
5,276,310 A * 1/1994 Schmidt et al. ..... 219/521
5,725,037 A * 3/1998 Faulhaber ..... 144/285
5,727,835 A * 3/1998 Krush et al. ..... 296/37.6
5,981,909 A * 11/1999 Freeman ..... 219/386
6,244,651 B1 * 6/2001 Hecock, Jr. ..... 296/100.12
6,254,251 B1 * 7/2001 Washington ..... 362/154
6,428,181 B1 * 8/2002 Moriarty ..... 362/154
6,571,949 B2 * 6/2003 Burrus et al. ..... 206/373
6,596,941 B2 * 7/2003 Tripoli ..... 174/68.1
6,693,260 B1 * 2/2004 Rodrigues ..... 219/385
6,713,727 B1 * 3/2004 Johnson ..... 219/386
6,759,636 B2 * 7/2004 Stutman ..... 219/679
2005/0103212 A1 * 5/2005 Cronin et al. ..... 99/467
2005/0103783 A1 * 5/2005 Bergum et al. ..... 220/23.86
2005/0274712 A1 * 12/2005 Gagas et al. ..... 219/494

* cited by examiner

*Primary Examiner* — Joseph M Pelham

(74) *Attorney, Agent, or Firm* — Lathrop & Gage LLP

(57) ABSTRACT

A heated construction box includes a heater constructed for generating heat within the construction box when connected to a power source. The construction box may include a dehumidifier, extendable supports and/or a retractable power cord assembly, as well as a cooled compartment, a hot plate and/or a microwave oven for heating or cooling solvent, paint, lacquer, epoxy, sealant, caulk, tar and the like, or food and beverage.

6 Claims, 18 Drawing Sheets

HEATED CONSTRUCTION BOX

RELATED APPLICATIONS

This application is a continuation-in-part of U.S. application Ser. No. 11/024,633, filed Dec. 29, 2004, which was a continuation-in-part of U.S. application Ser. No. 10/911,000, filed Aug. 4, 2004, each of which is incorporated herein by reference.

BACKGROUND

Construction workers on a construction site typically lock up tools, equipment and/or materials in a construction box when finishing work for the day. The construction box provides a secure location for the tools, equipment and/or materials, although it is often located in partially-finished or unheated buildings, or even outdoors.

When the environmental conditions around the construction box are cold or damp, condensation or even ice may form on the tools, equipment and/or materials causing damage. Condensation may also occur where large temperature variation occurs between day and night. Overnight temperature drop increases the probability of condensation forming on the tools, equipment and/or materials. Even where tools are stored in airtight construction boxes, moisture may still exist within the construction box. For example, where tools are used in a wet environment (e.g., during precipitation), the tools may be wet or damp when placed into the construction box; underlying moisture may induce rusting of the tools and/or other equipment within the construction box.

SUMMARY

To prevent damage to tools, equipment and materials stored in a construction box, the construction box is heated to maintain a desired temperature within the construction box. By maintaining a temperature within the construction box, for example, above a dew point, condensation on the tools, equipment and materials may be avoided. Also, by maintaining a temperature within the construction box above freezing point, for example, frost and/or ice damage may be avoided.

In one embodiment, a heated construction box system includes a construction box, a heater for generating heat within the construction box when connected to a power source and a plurality of extendable supports for elevating and supporting the construction box in a free-standing configuration.

In one embodiment, a heated construction box system includes a construction box comprising a plurality of adjoining walls, a base and a lid. The lid is hinged to one or more walls to provide access to the construction box. The system further includes a heater for generating heat within the construction box when connected to a power source, a relative humidity sensor, a controller responsive to the relative humidity sensor to maintain a set minimum relative humidity within the construction box and a dehumidifier responsive to the controller to reduce humidity within the construction box.

In one embodiment, a heated construction box system includes a construction box comprising a plurality of adjoining walls, a base and a lid. The lid is hinged to one or more walls to provide access to the construction box. The system further includes a heater for generating heat within the construction box when connected to a power source and an ultraviolet lamp for providing radiation to sterilize objects within the construction box.

In one embodiment, a heated construction box system includes a construction box, a heater for generating heat within the construction box when connected to a power source and a retractable power cord assembly for facilitating a transfer of power between the construction box and an external device.

In one embodiment, a heated construction box system includes a construction box comprising a plurality of adjoining walls, a base and a lid. The lid is hinged to one or more walls to provide access to the construction box, and the plurality of adjoining walls and the base form a first compartment and a second compartment. A heat exchange device transfers heat from the first compartment to the second compartment when connected to a power source.

In one embodiment, a heated construction box system includes a construction box comprising a plurality of adjoining walls, a base and a lid. The lid is hinged to one or more walls to provide access to the construction box. The system further includes a heater for generating heat within the construction box when connected to a power source and a hot plate for conductively transferring heat from the hot plate to an object in contact with the hot plate.

In one embodiment, a heated construction box system includes a construction box comprising a plurality of adjoining walls, a base and a lid. The lid is hinged to one or more walls to provide access to the construction box. The system further includes a heater for generating heat within the construction box when connected to a power source and a microwave oven for heating one or more objects placed within the microwave oven.

DETAILED DESCRIPTION OF THE FIGURES

A "construction box" as hereinafter described may refer to a container within which tools, equipment and/or materials associated with construction sites may be stored. The size and shape of the construction box are a matter of design choice, but, in general, the construction box comprises a plurality of adjoining walls, a base and a lid, where the lid is hinged to one or more walls to provide access to the construction box. In one example, the construction box may be just large enough (for example the size of a tool chest) to store the tools, equipment and/or materials. In another example, the construction box may also serve as an office so that personnel at the construction site may utilize office space within the construction box; such a construction box may therefore be large enough to accommodate persons sitting or even walking within the construction box. In another example, the construction box may be sized to fit within and on a flatbed of a truck, such as a pick-up truck or a U.S. Postal Service truck (or other delivery service vehicle). In another example, the construction box may be a permanent part of a vehicle or trailer. In another example, the construction box may be sized to fit within another storage box.

The construction box may be made from a metal such as aluminum; however it may instead be made from a rubber or plastic-type material (e.g., polyurethane) or from multiple materials (e.g., silicon rubber coated steel or powder coated steel). In one embodiment, the construction box is made by molding rubber or plastic material.

Figure 1:
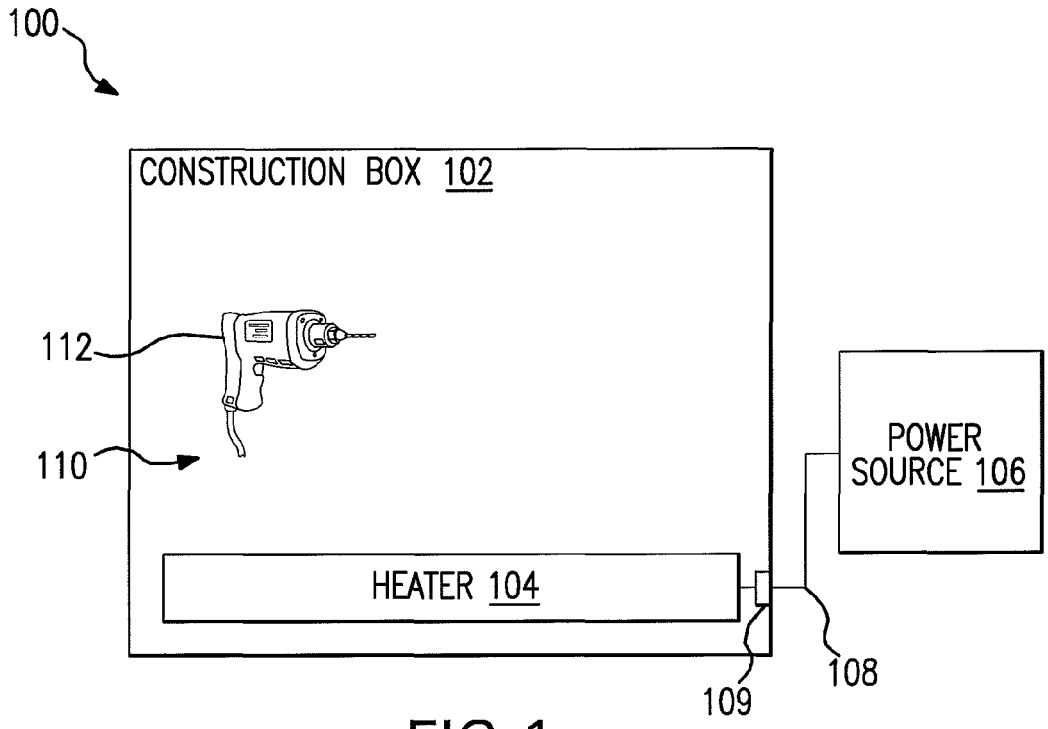
FIG. 1 shows one exemplary system embodiment that has a heated construction box.

FIG. 1 shows one exemplary system 100 that has a heated construction box 102. Heated construction box 102 provides a heated environment 110 for tools 112 within construction box 102. Tools 112 are, for example, electric power tools, tools with moving parts, tools with plastic mechanisms, other useful tools, equipment and/or materials for a construction site.

In the illustrated embodiment, construction box 102 has a heater 104 that receives power from a power source 106 through cable 108. Heater 104, in this example, is not thermostatically controlled and operates continually while connected to power source 106. Heater 104 may be a low-powered heating unit designed for continual operation such that temperature of environment 110 within construction box 102 is maintained above ambient temperature outside construction box 102. Heater 104 is, for example, a strip or cable heater of the type available from Chromalox®, and power source 106 is, for example, a 120V domestic electricity supply. Optionally, construction box 102 may include a socket 109 such that cable 108 may be disconnected from construction box 102.

Figure 2:
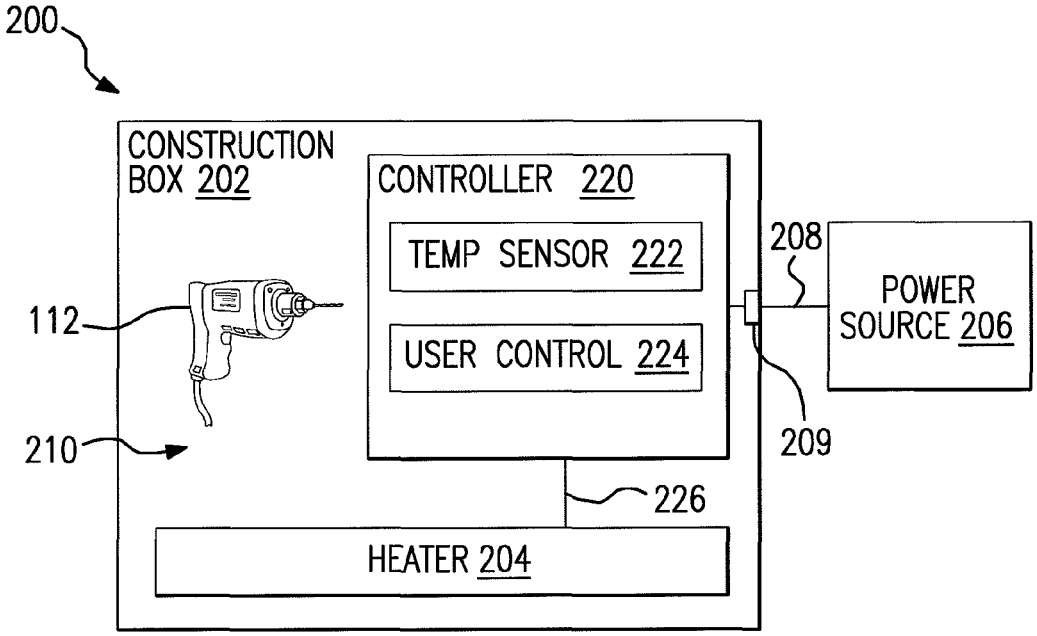
FIG. 2 shows one exemplary system embodiment that has a heated construction box with a controller and temperature sensing.

FIG. 2 shows one exemplary system 200 that has a heated construction box 202. Heated construction box 202 provides a heated environment 210 for tools 112 within heated construction box 202. Construction box 202 has a heater 204 that is controlled by a controller 220. Controller 220 includes a temperature sensor 222 and, optionally, a user control 224 that allows a user to set a desired minimum temperature for environment 210.

Controller 220 utilizes temperature sensor 222 to measure temperature of environment 210 and compares the measured temperature with the desired minimum temperature. Controller 220 receives power from a power source 206, via a cable 208, and operates to connect and disconnect power to heater 204 to maintain the temperature of environment 210 above or equal to the desired minimum temperature. In one example of operation, controller 220 has hysteresis: as temperature of environment 210 falls below the desired temperature (e.g., set by user control 224), controller 220 connects power to heater 204 through cable 226. As temperature rises above the desired temperature, controller 220 disconnects heater 204 from power source 206. User control 224 may, for example, include an on/off switch to activate and deactivate controller 220 and/or heater 204. Optionally, construction box 202 may include a socket 209 such that cable 208 may be disconnected from construction box 202.

In one embodiment, user control 224 is internal to controller 220 and is preset to a temperature (a few degrees above the freezing point of water, for example), such that environment 210 is maintained at or above that temperature. One exemplary combined heater and controller (suitable for controller 220) is a silicon rubber insulated enclosure and air heater by Chromalox®, available in various power ratings to suit various sized heated construction boxes. The Chromalox® heater may also include a thermostatic control that allows the temperature to be set by a user. In one embodiment, the Chromalox® heater has a preset thermostatic controller that maintains temperature above the freezing point of water. A heater with a high/low temperature sensor may also be employed.

Figure 3:
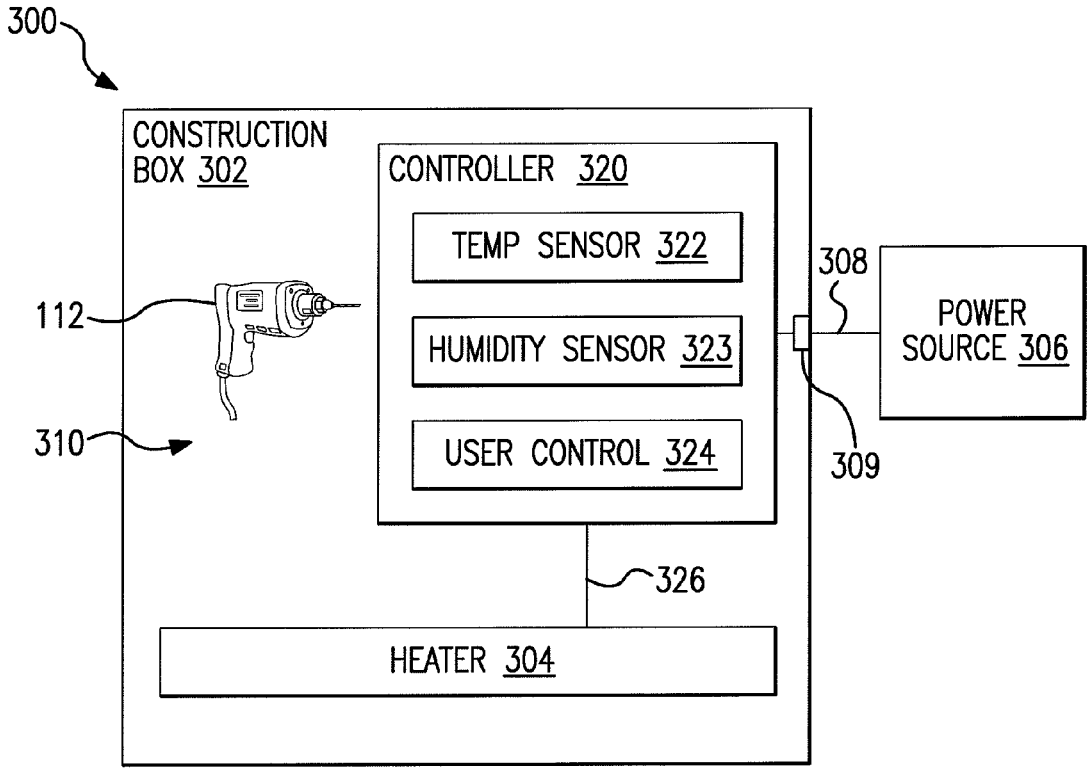
FIG. 3 shows one exemplary system embodiment that has a heated construction box with a controller and temperature and relative humidity sensing.

FIG. 3 is one exemplary system 300 that has a heated construction box 302. Heated construction box 302 provides a heated environment 310 for tools 112 within heated construction box 302. Heated construction box 302 has a heater 304 that is controlled by a controller 320. Controller 320 includes a temperature sensor 322, a relative humidity sensor 323 and, optionally, a user control 324 that allows a user to set a desired minimum temperature and maximum relative humidity, for example, for environment 310.

Controller 320 utilizes temperature sensor 322 to measure temperature of environment 310 and humidity sensor 323 to measure humidity of environment 310. Controller 320 compares the measured temperature and relative humidity with the desired minimum temperature and maximum relative humidity. Controller 320 receives power from a power source 306, via cable 308, and operates to connect and disconnect power to heater 304 to maintain temperature and relative humidity of environment 310. As appreciated, the relative humidity of environment 310 may be lowered by increasing the temperature of environment 310. Controller 320 thus operates to connect and disconnect power source 306 to and from heater 304, to maintain environment 310 based upon measured temperature and relative humidity of environment 310.

In one example, controller 320 connects heater 304 to power source 306 when temperature within environment 310 falls below the desired temperature and disconnects heater 304 from power source 306 when temperature of environment 310 increases above the desired temperature. In another example, controller 320 connects heater 304 to power source 306 when relative humidity of environment 310 increases above the desired relative humidity, and disconnects heater 304 from power source 306 when relative humidity falls below the desired relative humidity. User control 324 may, for example, include an on/off switch to activate and deactivate controller 320 and/or heater 304. Optionally, construction box 302 may include a socket 309 such that cable 308 may be disconnected from construction box 302.

In another embodiment of system 300, there is no user control 324; instead controller 320 operates to maintain temperature of environment 310 above the freezing temperature of water and to maintain the relative humidity below the condensation point (dew point). Thus, controller 320 may automatically operate to maintain environment 310 such that tools 112 stored therein are not damaged by frost or condensation, thereby preventing rusting or corrosion.

In yet another embodiment, construction box 302 includes a dehumidifier (not shown) to assist in maintenance of a desired relative humidity within environment 310. Controller 320 may connect the dehumidifier to power source 306 when relative humidity of environment 310 increases above the desired relative humidity, and disconnect the dehumidifier from power source 306 when relative humidity falls below the desired relative humidity. User control 324 may, for example, include an on/off switch to activate and deactivate controller 320, heater 304 and/or the dehumidifier. The dehumidifier may, for example, be a mechanical/refrigerative dehumidifier or a desiccant dehumidifier optionally containing a fan to move air over the desiccant.

Figure 4A:
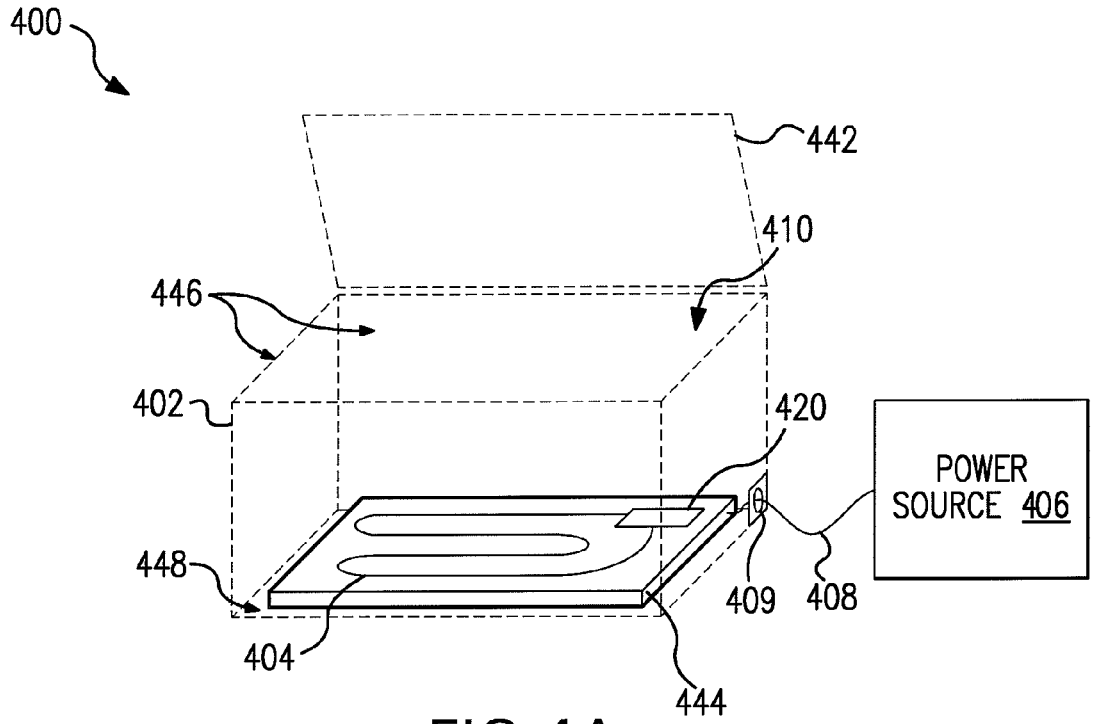
FIG. 4A is a perspective view illustrating one exemplary heated construction box in accord with one embodiment.

FIG. 4A shows a perspective view of one exemplary system 400 that includes a construction box 402 and an external power source 406. Construction box 402 is shown with a lid 442 that is hinged to allow access to an environment 410 within construction box 402, for example to place tools (e.g., tools 112) within heated construction box 402. A heater 404 with a built-in thermostat 420 is shown as a single unit 444 within heated construction box 402.

Construction box 402 may also have insulated walls 446, floor 448 and lid 442, and may be sealed when closed to increase efficiency of maintaining environment 410, for example. Optionally, construction box 402 may include a socket 409 such that cable 408 may be disconnected from construction box 402.

Figure 4B:
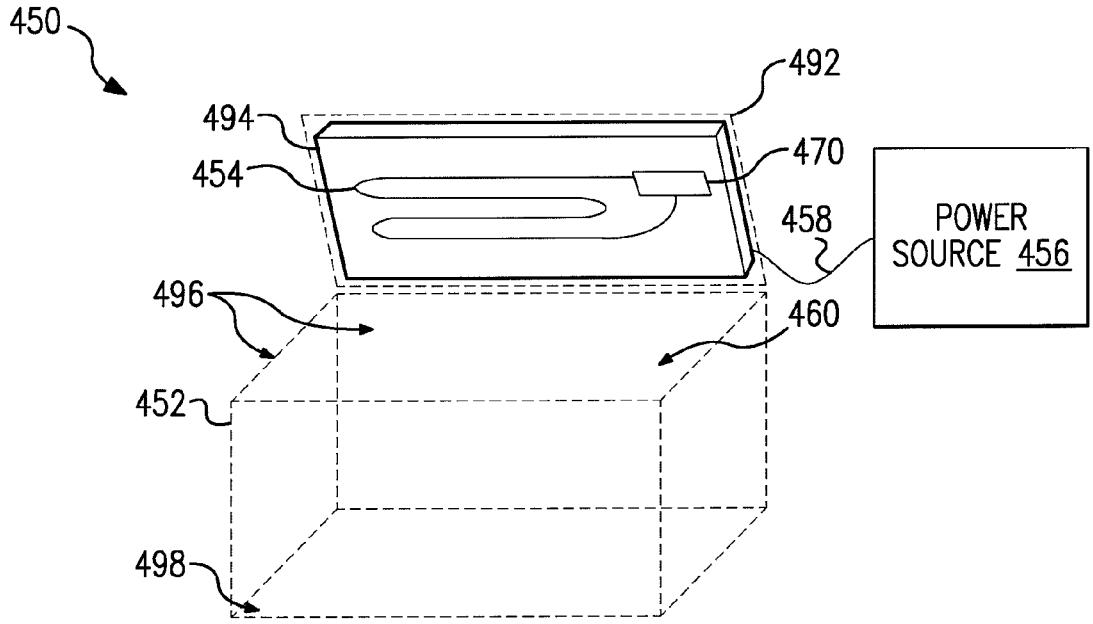
FIG. 4B is a perspective view illustrating one exemplary heated construction box with a heated lid in accord with one embodiment.

FIG. 4B shows a perspective view of one exemplary system 450 that includes a construction box 452 and an external power source 456. Construction box 452 is shown with a lid 492 that may be hinged to allow access to an environment 460 within construction box 452, for example to place tools (e.g., tools 112) within heated construction box 452. A heater 454 with a built-in thermostat 470 is shown as a single unit 494 constructed within lid 492 of heated construction box 452. Construction box 452 may have insulated walls 496 and floor 498. Lid 492 may also be insulated and may be sealed when closed to increase efficiency of maintaining environment 460, for example. Since heater 454 is located in lid 492, construction box 452 may serve as a warmed seat when lid 492 is closed and heater 454 is operational. Specifically, a person may then sit on lid 492 to warm herself when heater 454 is operational.

In one embodiment, construction box 102, 202, 302, 402 or 452 may include a fan (not shown) to improve efficiency of heater 104, 204, 304, 404 or 454, respectively, and to maintain an even heat distribution within environment 110, 210, 310, 410 or 460, respectively.

In one embodiment, any of the above-described power sources (e.g., power source 106, 206, 306, 406 or 456) may be a 120V electricity supply such that the cable connection to power (e.g., cable 108, 208, 308, 408 or 458, respectively) includes a standard plug to connect to a 120V wall socket. In another embodiment, the power source is a battery; in this case, the cable may further include a cigarette lighter type plug to facilitate connection. In one embodiment, the battery is located within the construction box, such as described in connection with FIG. 6A. In yet another embodiment, power source 106 is a generator; a construction box 102, 202, 302, 402 or 452 utilizing a generator power source may be remotely positioned without connection to an external power supply. Other power sources may also be utilized, including, for example, fuel and/or solar cells, wind and energy stores (i.e., electrical, thermal and/or mechanical energy stores). Construction box 102, 202, 302, 402 or 452 may also include a converter, such as shown in connection with FIG. 5B, for converting one type of power to another type of power. In one example, the converter comprises a transformer.

Heater 104, 204, 304, 404, 454 may take many forms, depending on the type of power available from its connected power source 106, 206, 306, 406, 456 respectively. The heater may for example be a radiant heater, a cable heater, a cast aluminum heater, a thermocouple, a platen heater, a plate heater, a tubular heater, a cast-in heater, an electric mat heater, a band heater, a drum heater, an enclosure heater and/or a strip heater. As appreciated, other types of heaters may be utilized as appropriate for the size and application of construction boxes 102, 202, 302, 402 and 452.

Figure 5A:
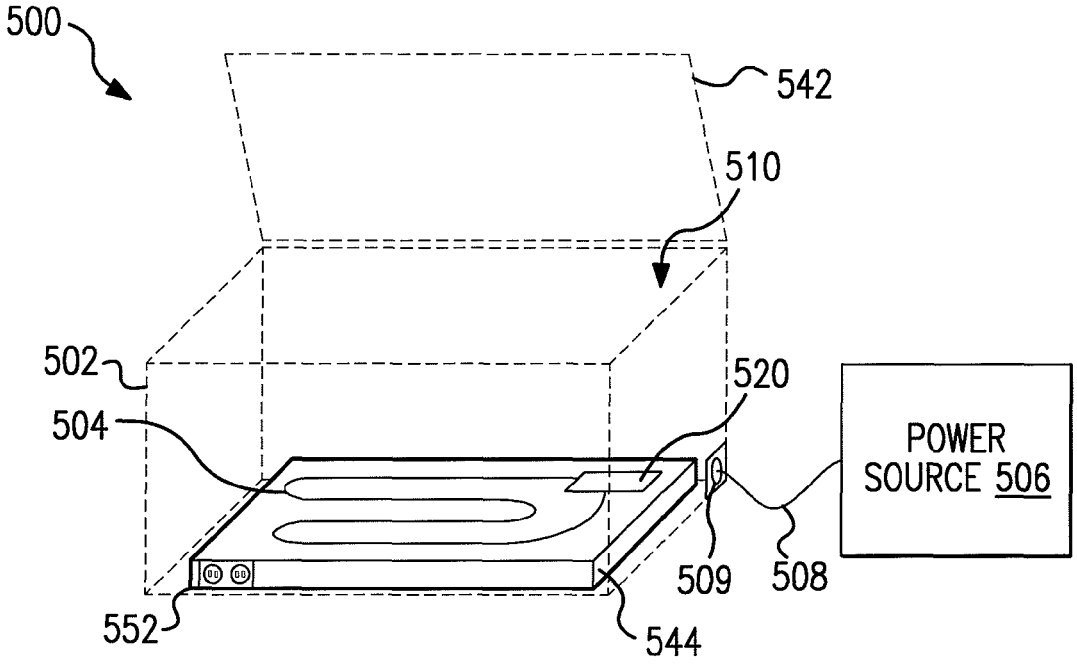
FIG. 5A is a perspective view illustrating one exemplary heated construction box with power outlets in accord with one embodiment.

FIG. 5A shows a construction box 502 with an external power source 506 and power outlets 552 (e.g., 120V sockets) to facilitate use of tools (e.g., tools 112, FIG. 1) or other power devices. Construction box 502 is shown with a lid 542 that is hinged to allow access to an environment 510 within construction box 502, for example to place tools (e.g., tools 112) within heated storage box 502. A heater 504 and a thermostat 520 are shown as a single unit 544 within heated construction box 502. Thermostat 520 operates to connect and disconnect heater 504 to power source 506, via a cable 508, to maintain a minimum temperature for environment 510. Power outlets 552 may be integrated with single unit 544, as shown, and connected to power source 506 via single unit 544 and cable 508. Or, power outlets 552 may be positioned at any suitable location on heated construction box 502 and connected by wiring to the power source. Optionally, construction box 502 may include a socket 509 such that cable 508 may be disconnected from construction box 502.

Figure 5B:
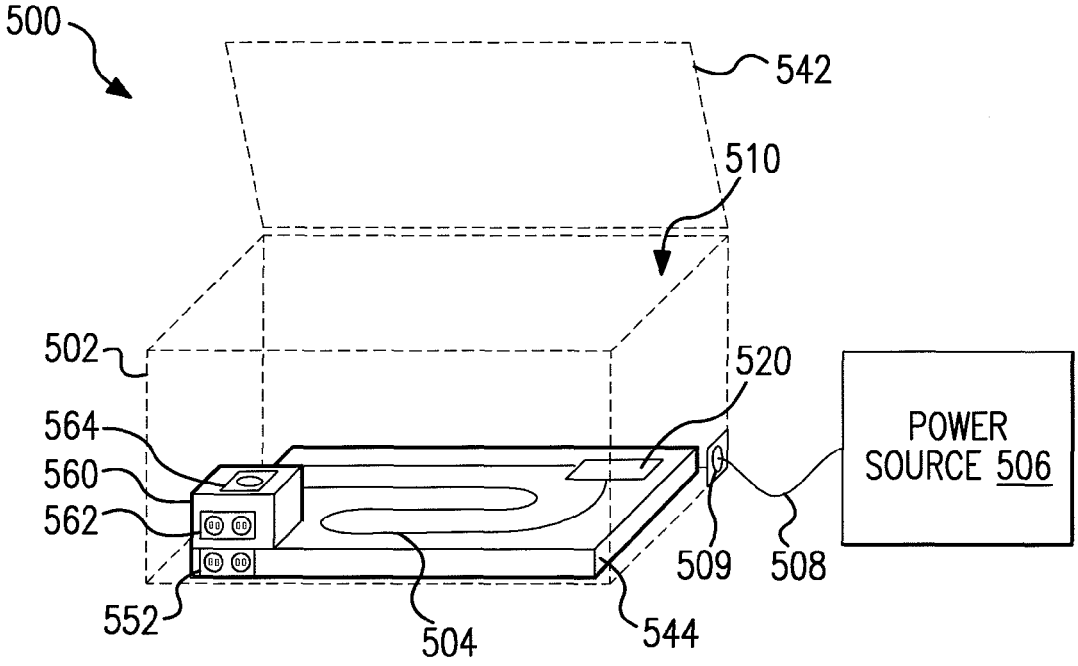
FIG. 5B is a perspective view illustrating one exemplary heated construction box with power outlets and a converter in accord with one embodiment.

FIG. 5B shows construction box 502 with a power converter 560 and additional power outlets 562, 564. Power converter 560 is, for example, an electrical transformer for converting electrical power at a first voltage to electrical power at a second voltage. Power converter 560 may connect to power source 506 via single unit 544 and cable 508. Power outlets 562 connect to power converter 560 to provide converted power to tools (e.g., tools 112, FIG. 1) or other power devices that require converted power. In one example, power converter 560 provides 12 Volt power to power outlets 562. Optional power outlet 564 connects to power converter 560 to provide power within construction box 502, so for example rechargeable power tools may be recharged while within the construction box. In another option, construction box 502 may include one or more receptacles (not shown) for recharging power tool batteries with power from power converter 560.

In one embodiment, where construction box 102, 202, 302, 402 or 502 is of an appropriate size, a top surface (e.g., lid 442, FIG. 4) of construction box 102, 202, 302, 402 or 502 may be utilized as a warmed seat.

Construction box 102, 202, 302, 402 or 502 may take almost any shape and/or size, depending upon application. For example, construction box 102, 202, 302, 402 or 502 may be sized to fit on the bed of a pickup truck, or may be sized to contain large tools, such that construction box 102, 202, 302, 402 or 502 is the size of a tool shed. Construction box 102, 202, 302, 402 may also include wheels and handles as appropriate to facilitate handling.

Construction box 102, 202, 302, 402 or 502 may also be utilized to store items other than tools. In one example, construction box 102, 202, 302, 402 or 502 may be mounted on the roof of a vehicle to house skis. In another example, construction box 102, 202, 302, 402 or 502 may be mounted on a trailer to store bicycles or other equipment. Construction box 102, 202, 302, 402 or 502 may thereby be constructed to store and transport items of different sizes and shapes.

Figure 8:
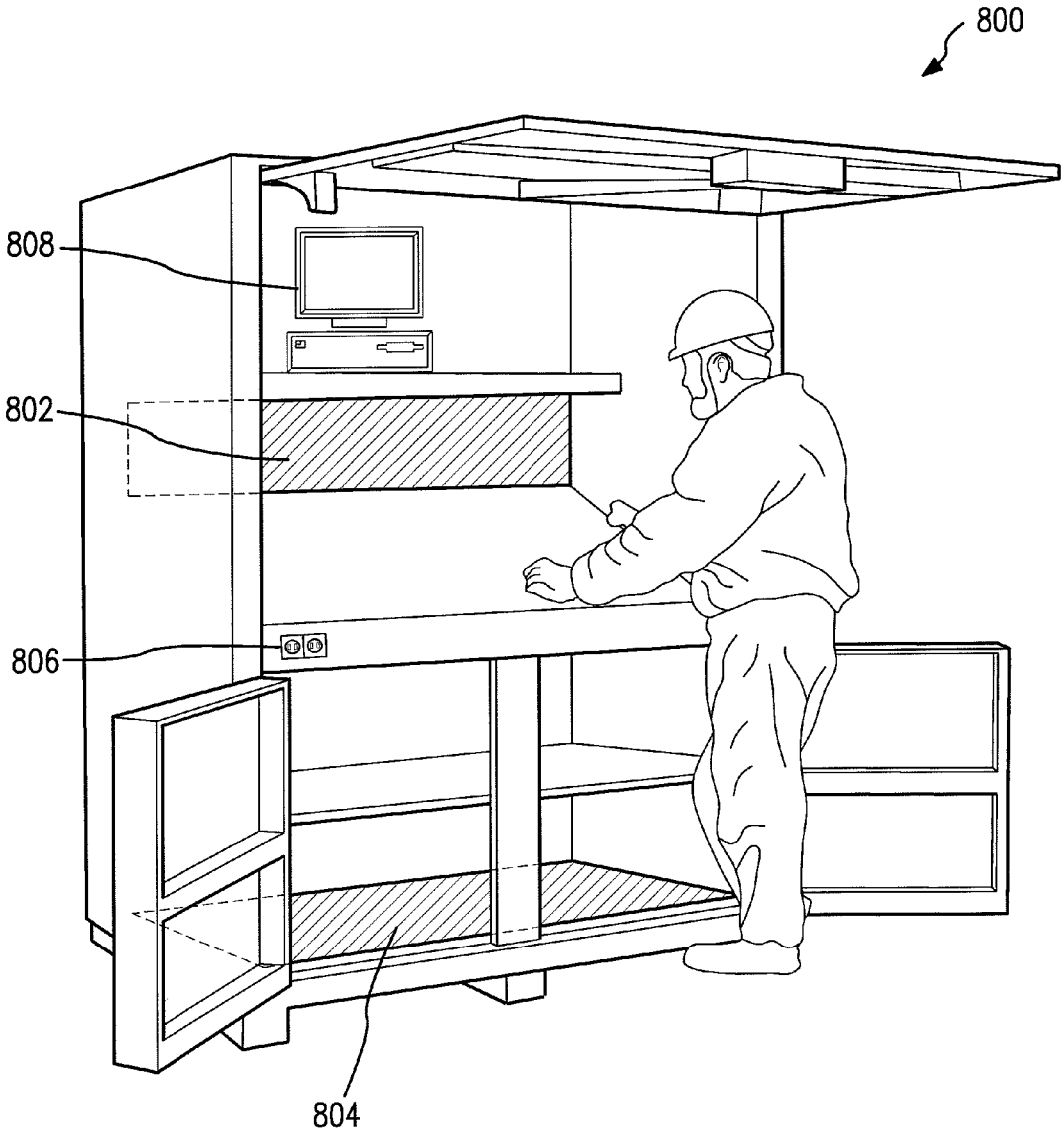
FIG. 8 is a perspective view of an exemplary heated office style construction box embodiment with power outlets.
Figure 9:
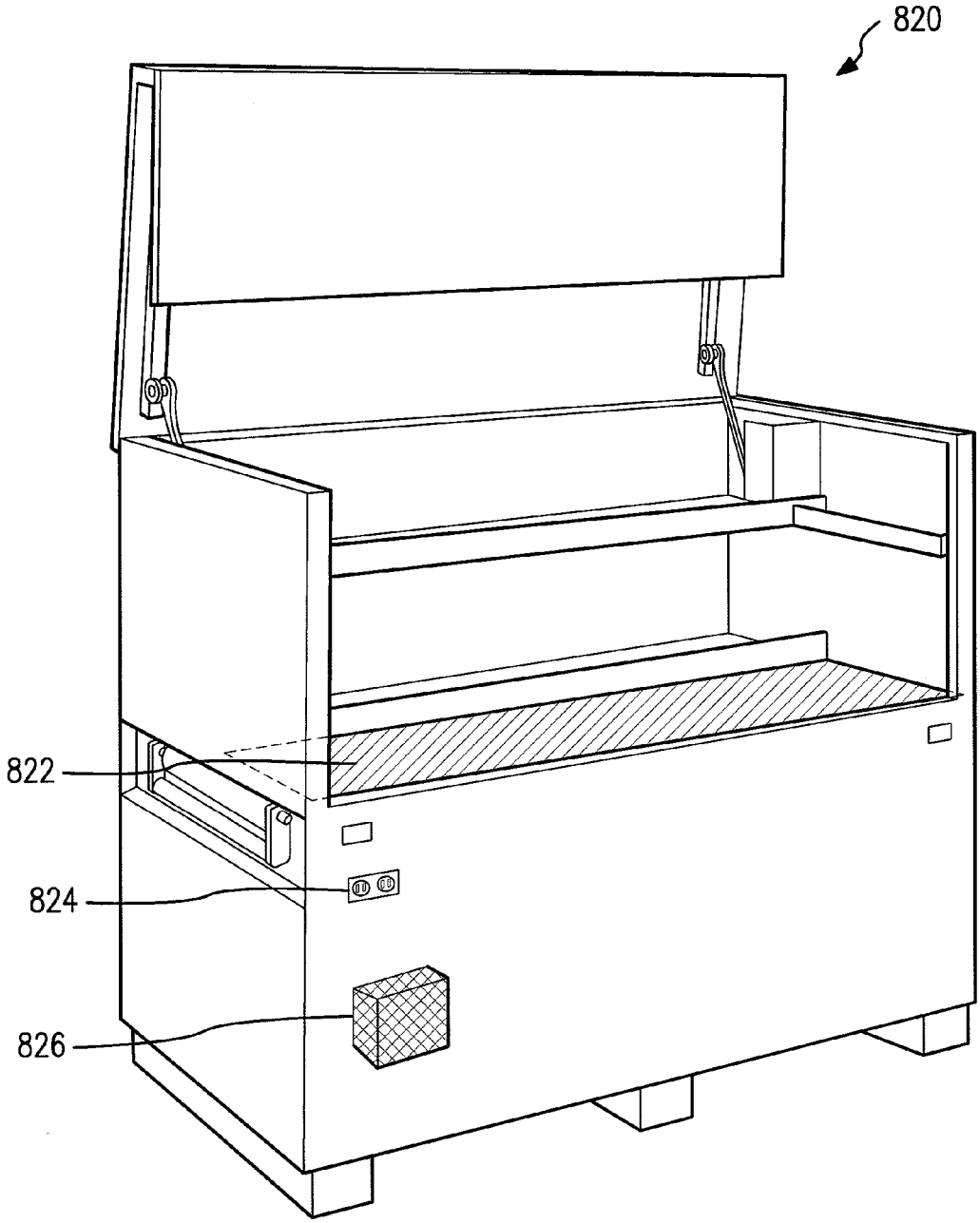
FIG. 9 is a perspective view of an exemplary heated workbench style construction box embodiment with a power source and power outlets.
Figure 10:
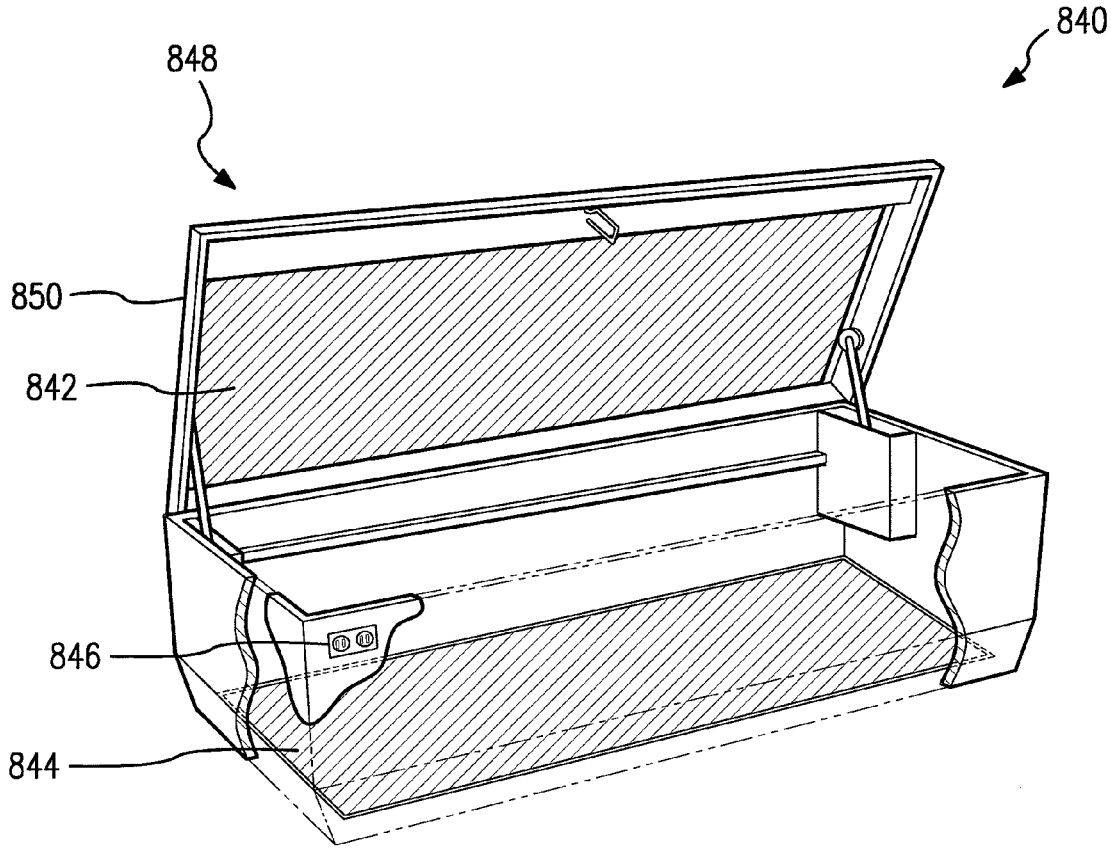
FIG. 10 is a perspective view of a heated chest style construction box embodiment with a heated seat and power outlets.
Figure 11:
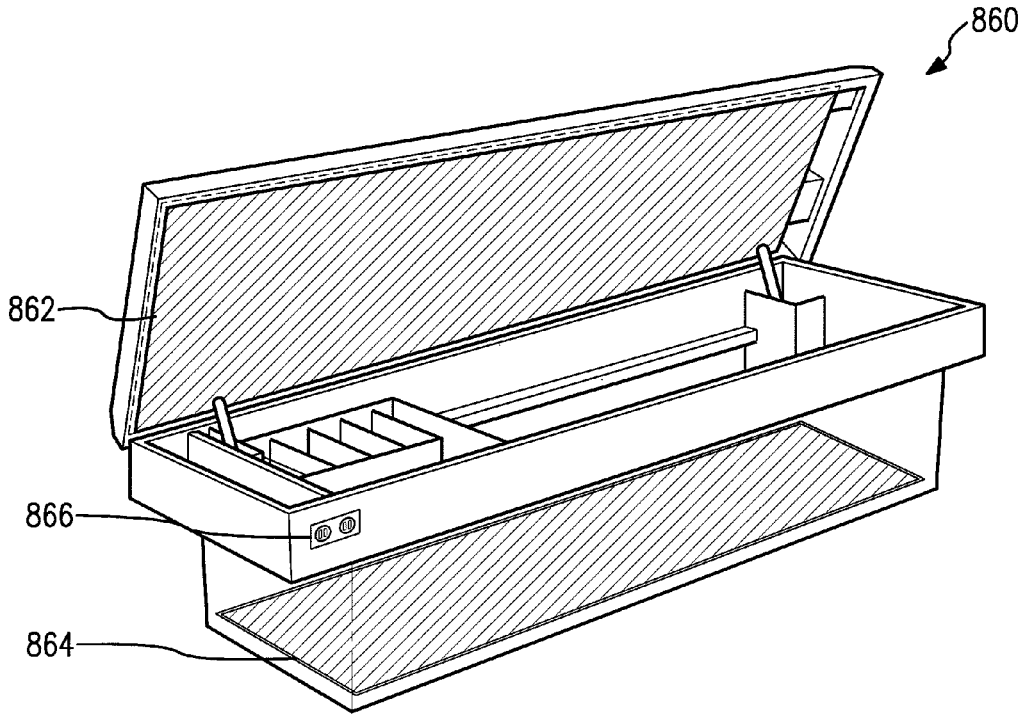
FIG. 11 is a perspective view of an exemplary heated saddle style construction box embodiment with power outlets.
Figure 12:
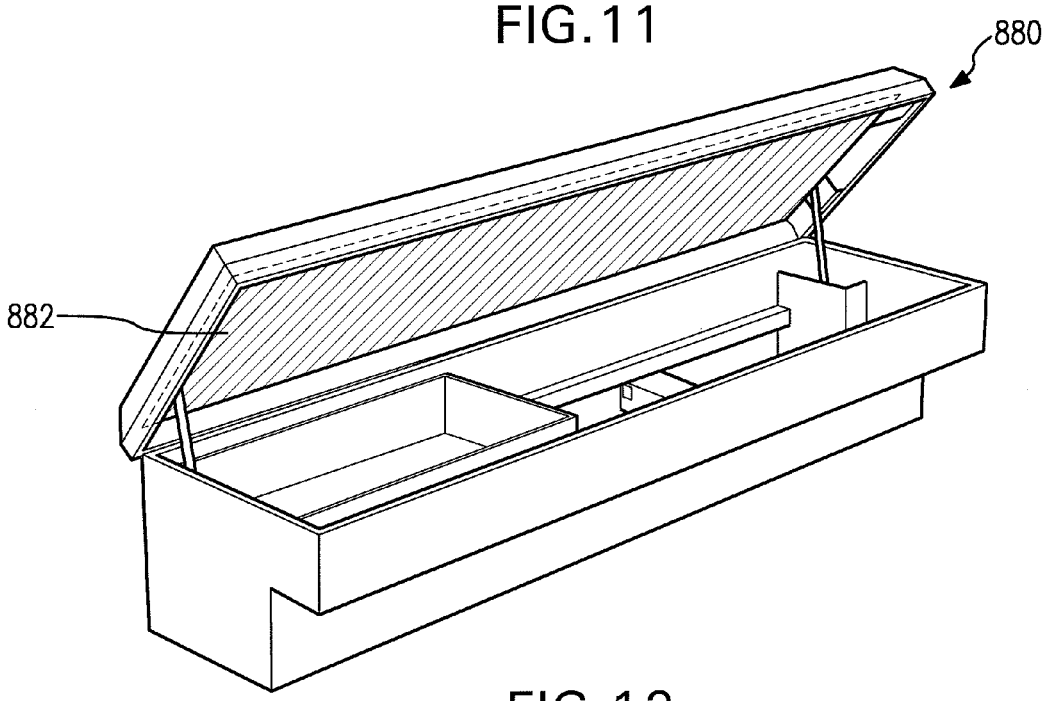
FIG. 12 is a perspective view of an exemplary heated low-side style construction box embodiment.

A heated construction box, such as construction boxes 102, 202, 302, 402 or 502, may take different forms and sizes; for example a construction box may be formed as an office style construction box 800, as shown in FIG. 8. In another embodiment, the construction box is formed as a workbench style construction box 820, as shown in FIG. 9. In another embodiment, the construction box is formed as a chest style construction box 840, as shown in FIG. 10. In another embodiment, the construction box is formed as a saddle style construction box 860, as shown in FIG. 11. In one embodiment, the construction box is formed as a low-side style construction box 880, as shown in FIG. 12.

In one embodiment, heater 204, 304, 404 or 504 and controller 220, 320, 420 or 520, respectively, are combined into a single unit (e.g., single unit 444, FIG. 4) that may be added to a contained environment to provide the above described environmental control. The single unit may, for example, be added to an unheated construction box to provide care of tools stored therein.

Figure 6A:
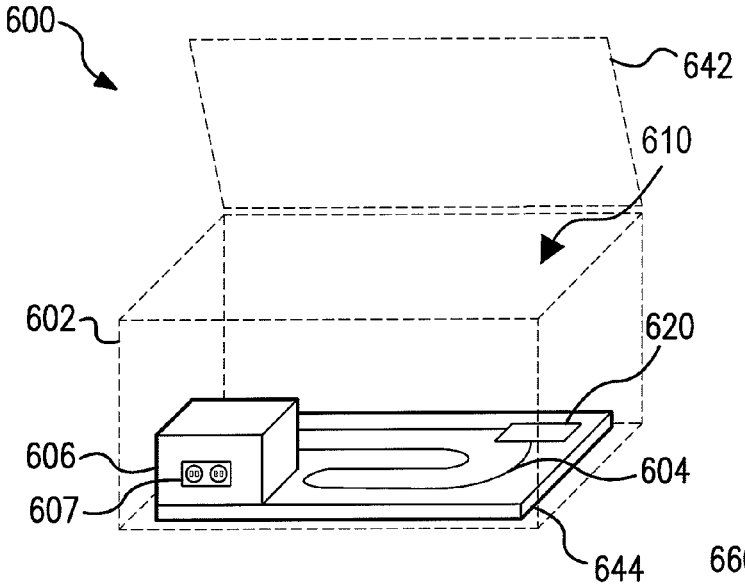
FIG. 6A is a perspective view illustrating one exemplary heated construction box that includes an internal power source in accord with one embodiment.

FIG. 6A shows an exemplary embodiment of one heated construction box 602 that has an internal power source 606. Construction box 602 is shown with a lid 642 that is hinged to allow access to an environment 610 within construction box 602, for example to place tools (e.g., tools 112, FIG. 1) within heated construction box 602. A heater 604 and a thermostat 620 are shown as a single unit 644 within heated construction box 602. Thermostat 620 operates to connect and disconnect heater 604 to and from power source 606 to maintain a temperature of environment 610 above a minimum set temperature. Power source 606 is, for example, a battery, fuel cell or other self contained power source. In one example, internal power source 606 is a rechargeable battery and heater 604 is a battery powered heating element. Optionally, power source 606 and/or construction box 602 may include power sockets 607 that connect to power source 606 to provide power (e.g., 12 Volt power) for power tools (e.g., 12 Volt power tools).

Figure 6B:
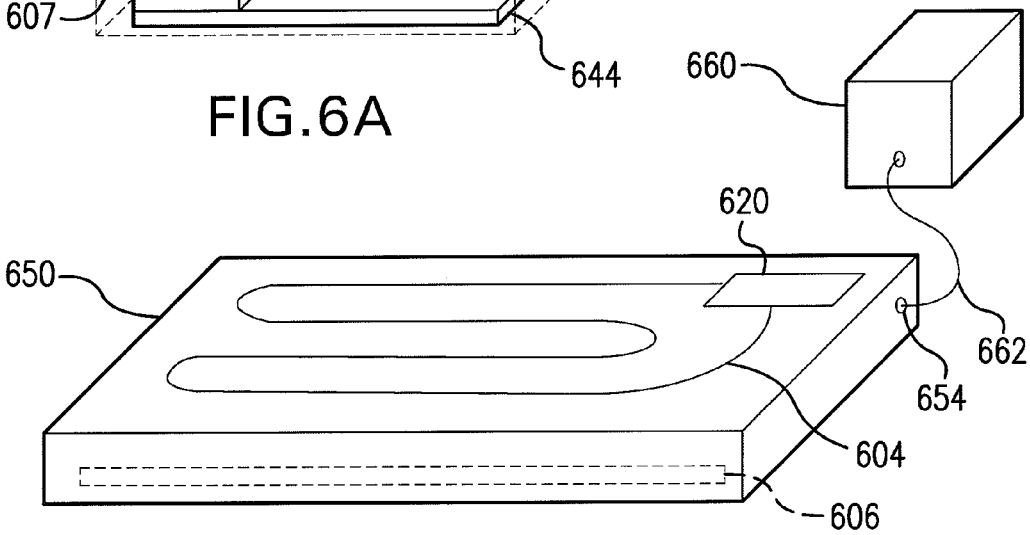
FIG. 6B is a perspective view illustrating one exemplary integrated unit connected to a charger in accord with one embodiment.
Figure 6C:
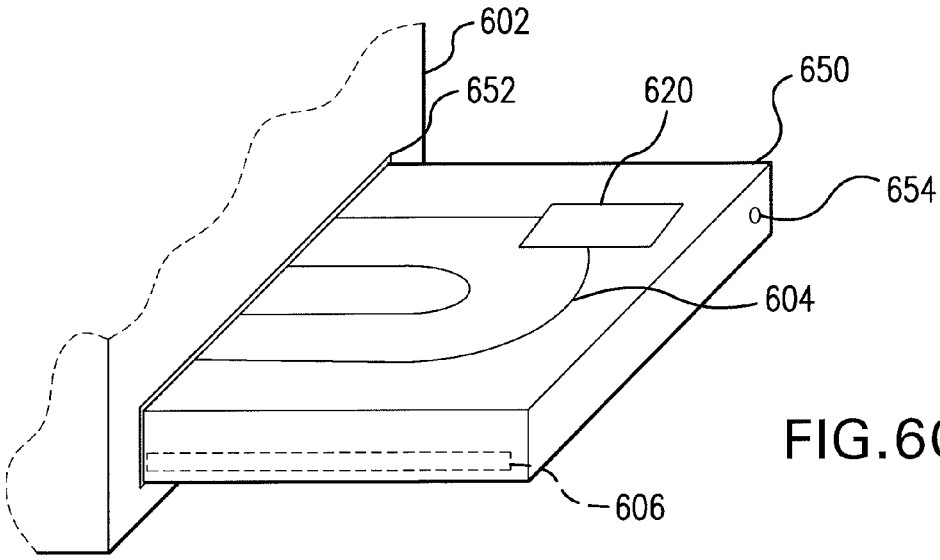
FIG. 6C is a perspective view illustrating the integrated unit of FIG. 6B being inserted into a construction box.

FIG. 6B shows an internal power source 606, heater 604 and controller 620 combined to form an integrated unit 650 that may be removed from construction box 602 and recharged. Internal power source 606 is, for example, a rechargeable battery. Integrated unit 650 is shown with a connector 654 that allows recharging of internal power source 606 by charger 660 and cord 662. Once recharged, integrated unit 650 may be slotted into construction box 602 as shown in FIG. 6C. A receptacle 652 within construction box 602 may for example provide for insertion and removal of integrated unit 650.

As appreciated, integrated unit 650 may be sized and shaped as appropriate for construction box 602. Integrated unit 650, when exhausted of stored energy, may thus be exchanged with a fully charged integrated unit 650, thereby allowing continual use of construction box 602 (i.e., one integrated unit 650 may be in use while a second integrated unit 650 is being recharged). As appreciated, integrated unit 650 may be sealed to prevent water damage, and constructed such that external power connections may not be accidentally shorted. Connector 654 is, for example a safety power connector that self-closes when cord 662 is disconnected.

In one embodiment, integrated unit 650 operates like a 12 Volt rechargeable battery pack suitable for portable power tools; and yet integrated unit 650 may also be charged and placed within a construction box (e.g., construction box 602) to provide heat.

In another embodiment, integrated unit 650 is completely sealed against moisture intrusion and has no external electrical contacts. In this embodiment, integrated unit 650 may include an induction coil such that internal power source 606 may be inductively recharged.

Figure 6D:
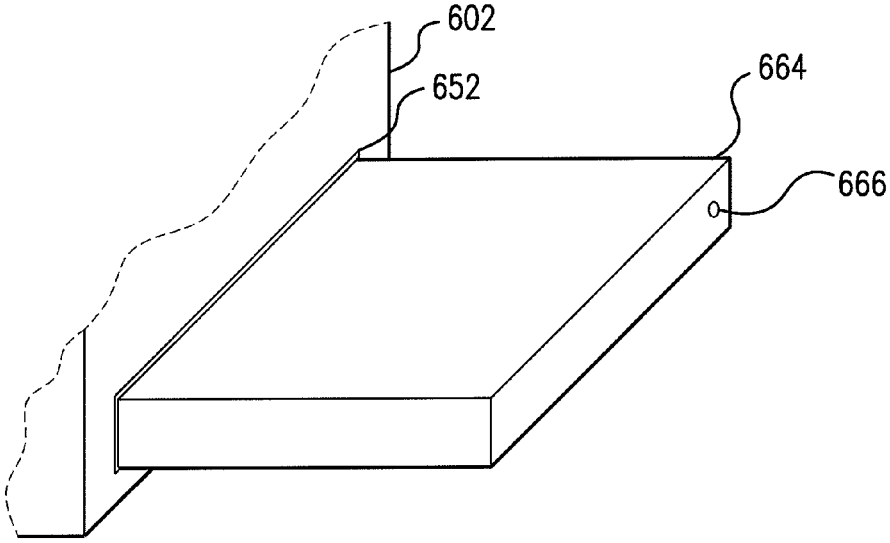
FIG. 6D is a perspective view illustrating one exemplary removable power source being removed from a construction box in accord with one embodiment.
Figure 6E:
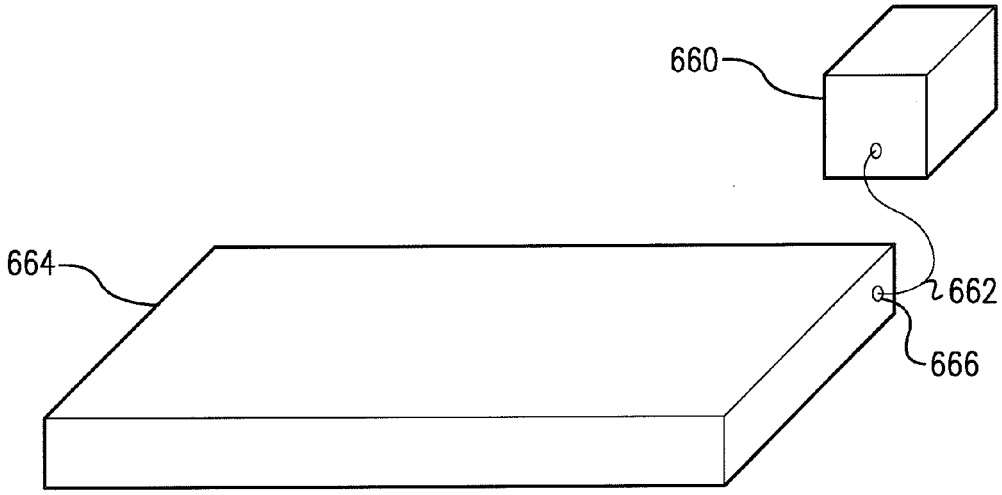
FIG. 6E is a perspective view illustrating the removable power source of FIG. 6D connected to a charger for recharging.

FIG. 6D shows one exemplary embodiment of construction box 602 where power source 664 (e.g., a rechargeable battery) is removable from a receptacle 652 of construction box 602. In this embodiment, heater 604 and controller 620 remain within construction box 602, and only power source 664 is removable. FIG. 6E shows power source 664 removed from construction box 602 and connected to charging unit 660 via cord 662 and a connector 666. Power source 664 may include a safety connector for connection to controller 620 and heater 604 (not shown) to prevent accidental shorting of power source 664. Further, power source 664 may include short circuit protection circuitry to enhance safety of power source 664. In one embodiment, power source 664 provides power at 12 Volts for use by portable power tools.

Figure 7:
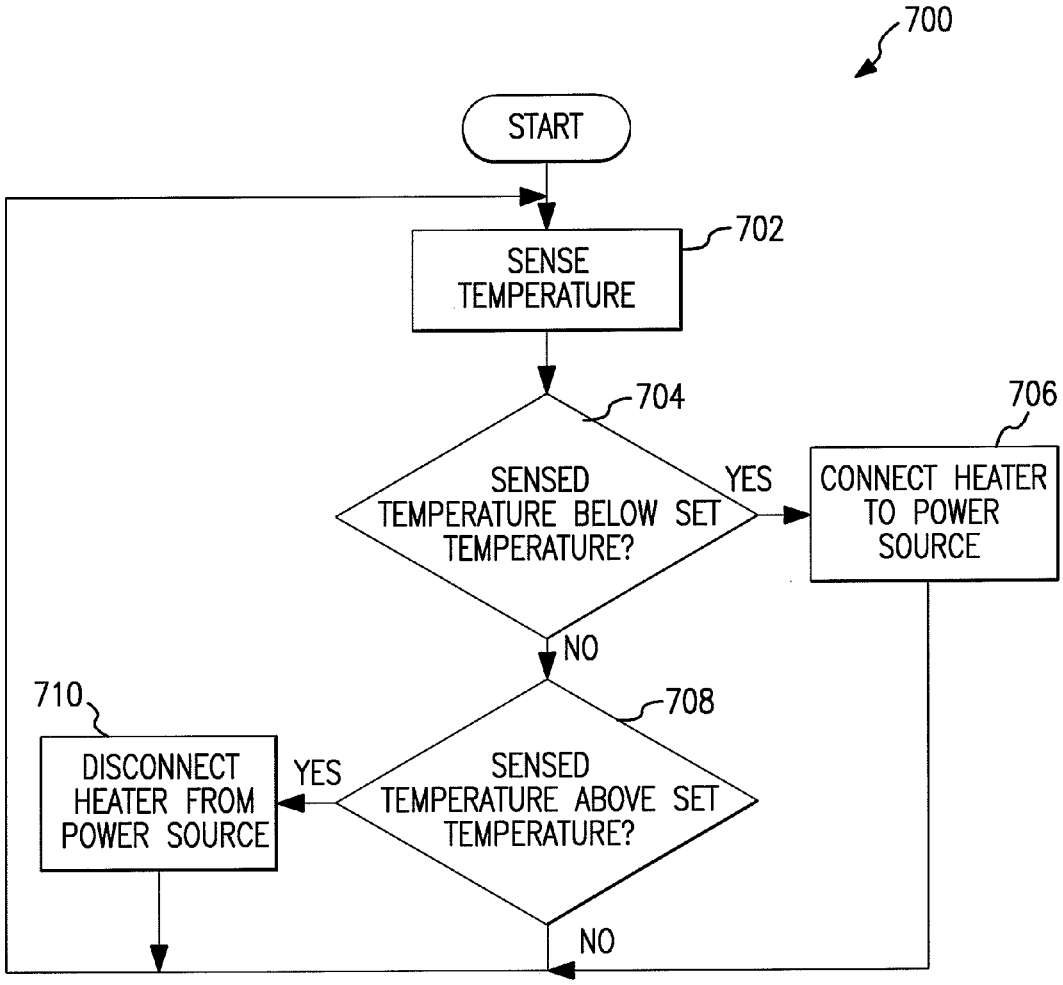
FIG. 7 is a flowchart illustrating one exemplary method embodiment for heating a construction box.

FIG. 7 is a flowchart illustrating one exemplary method 700 for maintaining a temperature within an environment of a construction box (e.g., construction box 202, 302, 402, 502, 602) above a minimum set temperature. In step 702, method 700 senses a temperature within the construction box. In one example of step 702, method 700 senses a temperature of environment 210, 310, 410, 510 or 610 within construction box 202, 302, 402, 502 or 602, respectively.

Step 704 is a decision. If, in step 704, method 700 determines that the temperature sensed in step 702 is below a set minimum temperature, method 700 continues with step 706; otherwise method 700 continues with step 708.

In step 706, method 700 connects a heater of the construction box to a power source. If the heater is already connected to the power source the heater remains connected to the power source. In one example of step 706, method 700 connects heater 204, 304, 404, 504 or 604 to power source 206, 306, 406, 506 or 606, respectively. Method 700 then continues with step 702.

Step 708 is a decision. If, in step 708, method 700 determines that the temperature sensed in step 702 is above the set temperature, method 700 continues with step 710; otherwise method 700 continues with step 702.

In step 710, method 700 disconnects the heater from the power source. If the heater is already disconnected from the power source, the heater remains disconnected from the power source. In one example of step 710, method 700 disconnects heater 204, 304, 404, 504 or 604 from power source 206, 306, 406, 506 or 606, respectively.

Steps 702, 704, 706, 708 and 710 are repeated to maintain the environment within the heated construction box above the set minimum temperature. As appreciated, steps 702, 704, 706, 708 and 710 may occur in a different order without departing from the scope herein.

FIG. 8 is a perspective view of an exemplary heated office style construction box 800 with power outlets 806. Construction box 800 is shown with two heaters 802, 804 and a computer system 808 that is protected from freezing conditions and condensation within construction box 800. As appreciated, heaters 802, 804 may include thermostatic controllers such that heat is generated when the temperature is below a user preset temperature, if desired.

FIG. 9 is a perspective view of an exemplary heated workbench style construction box 820 with a power source 826 and power outlets 824. Power outlets 824 connect to power source 826 to power hand tools, for example. Power source 826 also connects to heater 822 to maintain temperature within construction box 820. Heater 822 may include a thermostatic controller such that heat is generated below a user preset temperature only.

FIG. 10 is a perspective view of a heated chest style construction box 840 with a heated seat 848 and power outlets 846. Hinged lid 850 of construction box 840 includes a heater 842 to form a heated seat 848. A heater 844 within construction box 840 may include a thermostatic controller such that heat is generated to maintain a user preset temperature within construction box 840.

FIG. 11 is a perspective view of an exemplary heated saddle style construction box 860 with power outlets 866. Construction box 860 is suitable for mounting, cross-wise, within a bed of a pick-up truck. Construction box 860 is illustratively shown with two heaters 862, 864 that may include thermostatic controllers such that heat is generated to maintain a user preset temperature within construction box 860. Power outlets 866 may be used to provide power to hand tools. Construction box 860 may contain its own power source or, when fitted to a vehicle, may utilize power from the vehicle.

FIG. 12 is a perspective view of an exemplary heated low-side style construction box 880. Construction box 880 is suitable for mounting to a side rail of a pick-up truck, for example. Construction box 880 is illustratively shown with one heater 882 that may, when construction box 880 is mounted within a vehicle, receive power from the vehicle, in one embodiment.

Figure 13A:
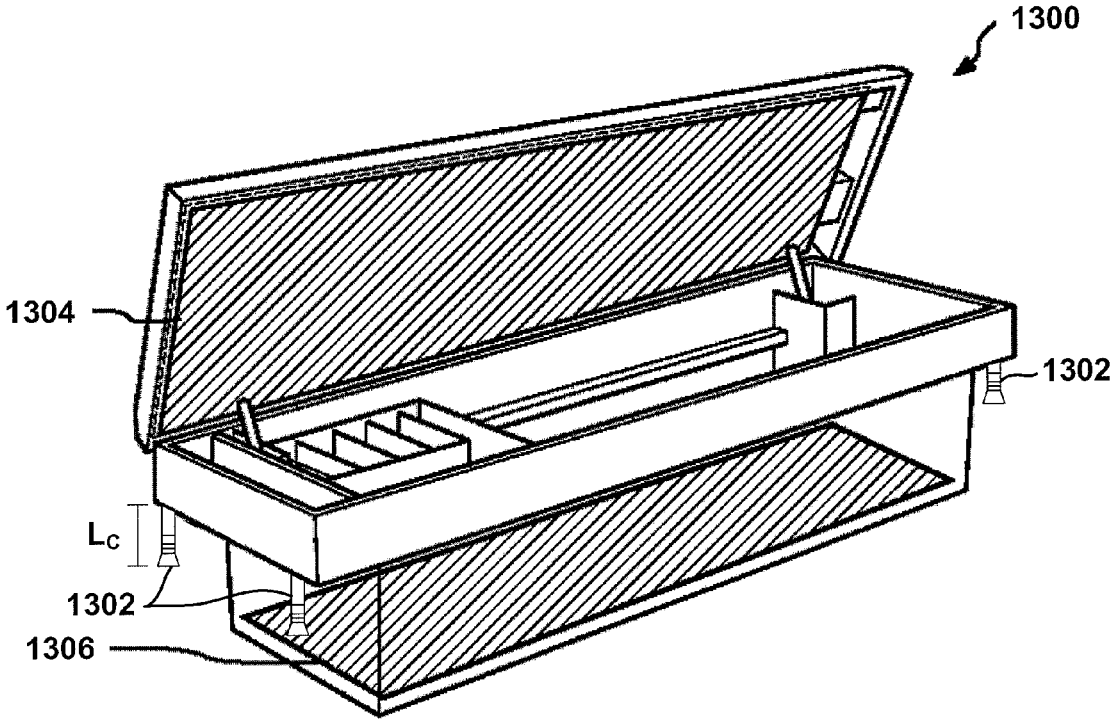
FIG. 13A is a perspective view of a heated saddle style construction box embodiment with extendable supports shown in a compressed configuration in accord with one embodiment.
Figure 13B:
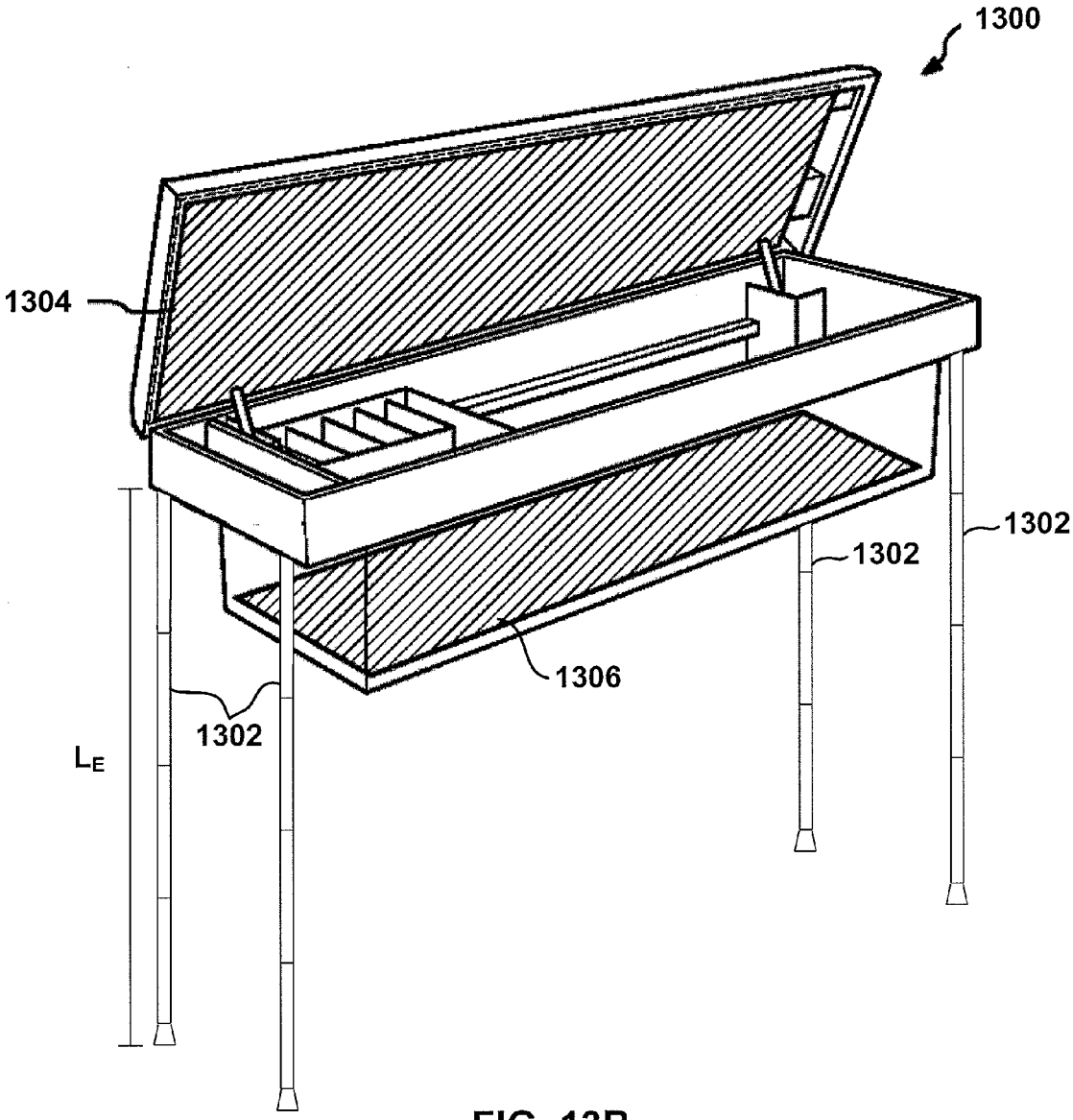
FIG. 13B is a perspective view of the construction box of FIG. 13A with extendable supports shown in an extended configuration in accord with one embodiment.

FIG. 13A is a perspective view of an exemplary heated saddle style construction box 1300 with extendable supports 1302. Extendable supports 1302 may be used to elevate and support construction box 1300 in a free-standing configuration, thereby facilitating insertion and removal of construction box 1300 into/from the bed of a pick-up truck. In FIG. 13A, extendable supports 1302 are shown in a compressed configuration, where the extendable supports are collapsed upon themselves to a length, $L_C$, of about six to twelve inches. In an extended configuration, shown in FIG. 13B, extendable supports 1302 are elongated and optionally locked at a length, $L_E$, ranging from $L_C$ to $L_E$, where $L_E$ may be two, three, four, five or six feet or any increment there between. Generally length, $L_E$, is at least sufficient to reach the ground from the position of the construction box 1300 in the bed of the pick-up truck. Beyond this minimum extension length, extendable supports 1302 may be used to elevate construction box 1300 from the pick-up truck bed so that a user may drive the truck into or out of position relative to the construction box. In one example, extendable supports 1302 may be removably mounted to construction box 1302, such that they may be stored within the construction box or another location when not in use.

Construction box 1300 is illustratively shown with two heaters 1304, 1306 that may include thermostatic controllers such that heat is generated to maintain a user preset temperature within construction box 1300. Power outlets (not shown) may be used to provide power to hand tools. Construction box 1300 may contain its own power source or, when fitted to a vehicle, may utilize power from the vehicle.

Figure 14:
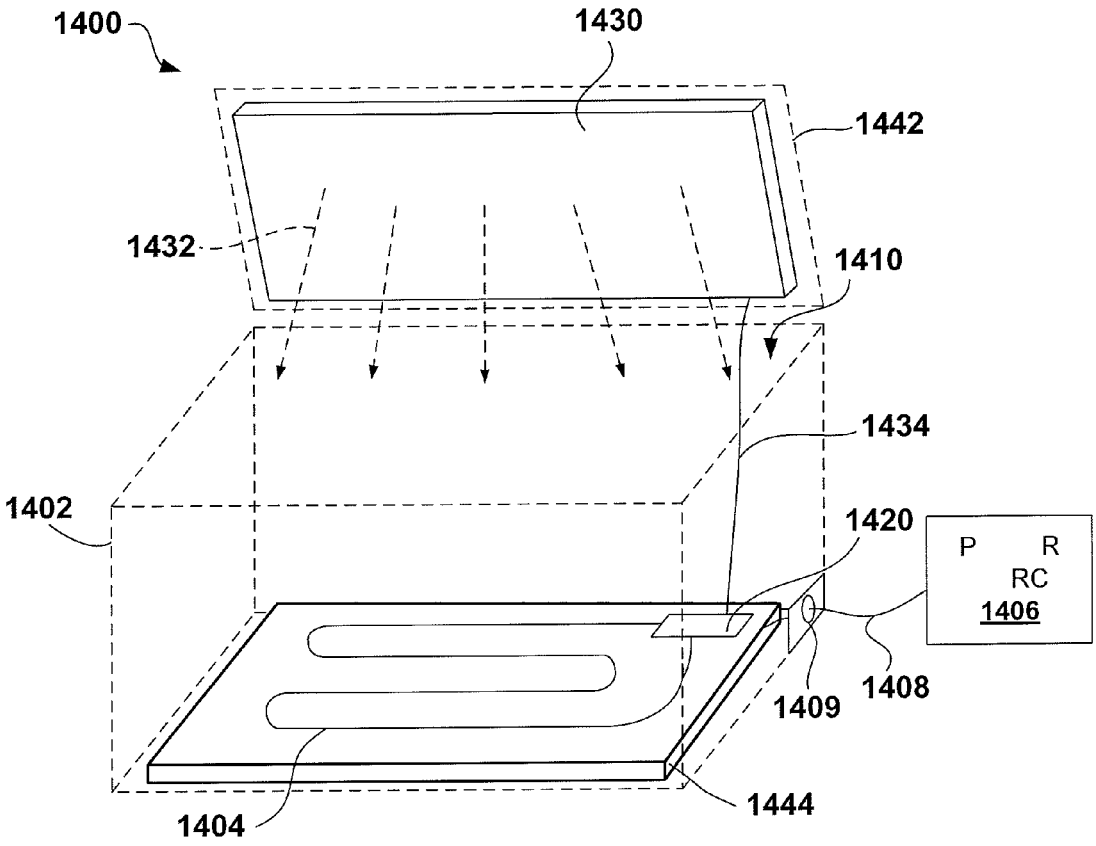
FIG. 14 is a perspective view illustrating one exemplary heated construction box with an ultraviolet lamp in accord with one embodiment.

FIG. 14 is a perspective view of one exemplary system 1400 that includes a construction box 1402, which is similar to construction box 502 of FIG. 5A, and has the additional feature of an ultraviolet lamp 1430. Construction box 1402 is shown with a lid 1442 that is hinged to allow access to an environment 1410 within construction box 1402, for example to place tools (e.g., tools 112) within heated construction box 1402. A heater 1404 with a built-in controller 1420 is shown as a single unit 1444 within heated construction box 1402. Optionally, construction box 1402 may include a socket 1409 such that cable 1408 may be disconnected from construction box 1402. Ultraviolet lamp 1430 is shown mounted to lid 1442, although other configurations that provide radiation to environment 1410 within construction box 1402 are suitable. Ultraviolet lamp 1430 receives power directly, or indirectly via controller 1420 and cable 1434 for example, from power source 1406. Radiation 1432 produced by ultraviolet lamp 1430 sterilizes tools (e.g., tools 112) within heated construction box 1402. For example, respirators, safety goggles and other equipment may benefit from sterilization.

Figure 15:
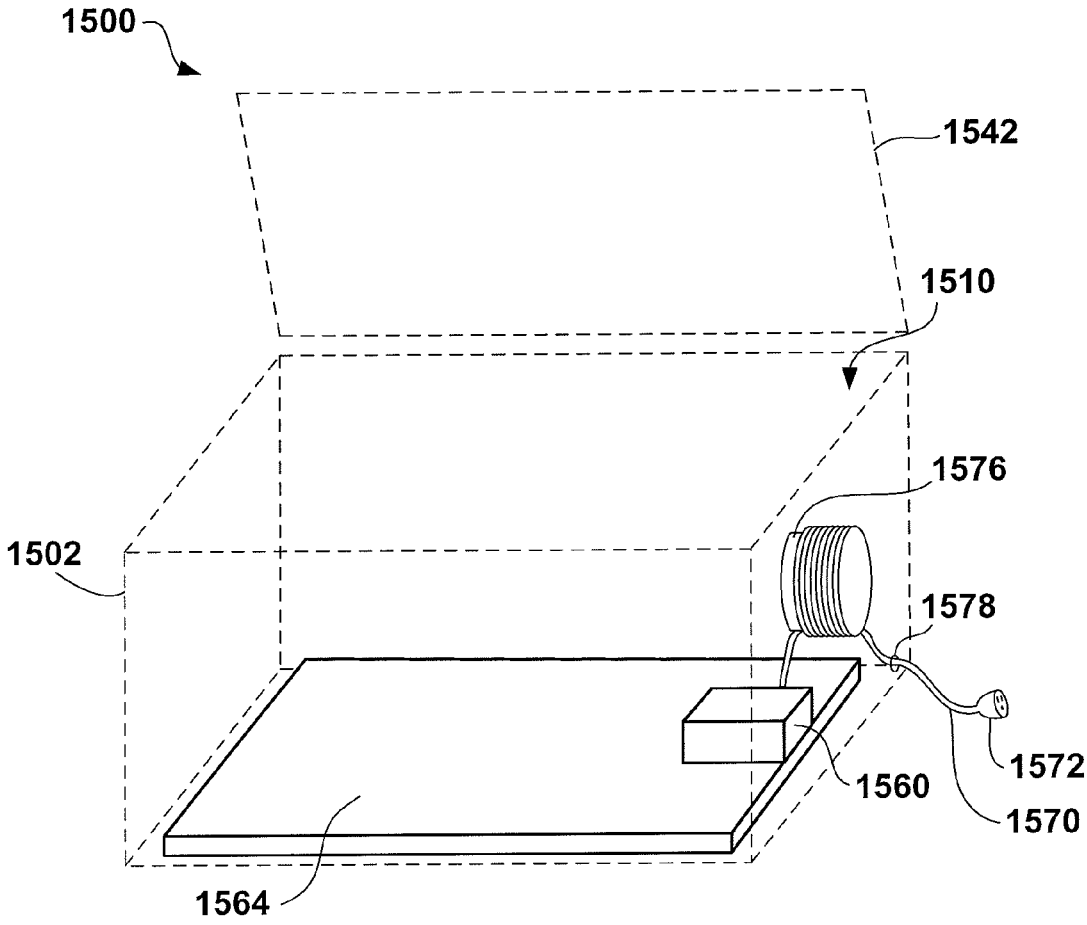
FIG. 15 is a perspective view illustrating one exemplary heated construction box with a retractable power cord assembly in accord with one embodiment.

FIG. 15 is a perspective view of one exemplary system 1500 that includes a construction box 1502 having a retractable power cord assembly. As shown, the retractable power cord assembly is mounted on an internal surface of construction box 1502, although external mounting is also possible. The power cord assembly includes a retractable power cord 1570 and a dowel 1576, which may be spring-loaded or motor driven. An opening 1578 in the wall of construction box 1502 provides a conduit through which retractable power cord 1570 is able to move. As appreciated, multiple retractable power cord assemblies may be provided in a single construction box 1502 and/or multiple retractable power cords 1570 may occupy a single dowel 1576. A power source 1564, or integrated unit (e.g., integrated unit 650, FIGS. 6B and 6C), and a power converter 1560 are shown within heated construction box 1502. Power converter 1560 may for example convert power from power source 1564 to 12 Volt power for use by external power devices. The converted power may be delivered to the external power devices via retractable power cord 1570. As shown retractable power cord 1570 contains a female socket 1572, but it will be appreciated that retractable power cord 1570 may alternatively be provided with a male socket.

In an alternate embodiment, retractable power cord 1570 may be used to access a remote power source (e.g., residential power) in order to charge power source 1564.

Figure 16:
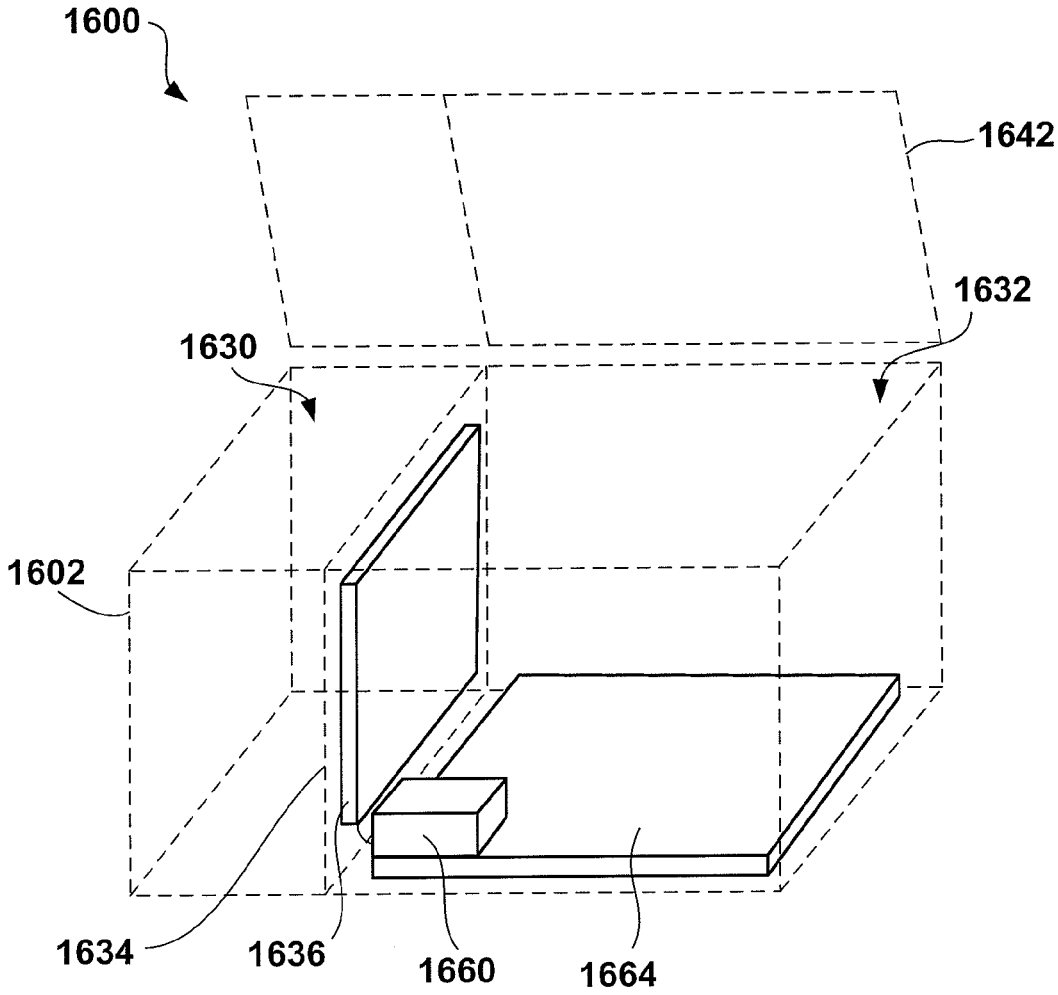
FIG. 16 is a perspective view illustrating one exemplary heated construction box with a cooled compartment in accord with one embodiment.

FIG. 16 is a perspective view illustrating one exemplary system 1600 that includes a construction box 1602 having a cooled compartment 1630. Cooled compartment 1630 is separated from heated compartment 1632 by a wall 1634 and a heat exchange device 1636, such as a Peltier device. Heat exchange device 1636 lowers the temperature of the cooled compartment 1630 while simultaneously raising the temperature of the heated compartment 1632. Cooled compartment 1630 may be used to store low boiling solvents, paints and the like, or food and beverage. A lid 1642 of construction box 1602 may be split to allow cooled compartment 1630 and heated compartment 1632 to be accessed independently. Heat exchange device 1636 may receive power from an external power supply (not shown), or from a power source 1664, or integrated unit (e.g., integrated unit 650, FIGS. 6B and 6C), that is optionally coupled with a power converter 1660.

Figure 17:
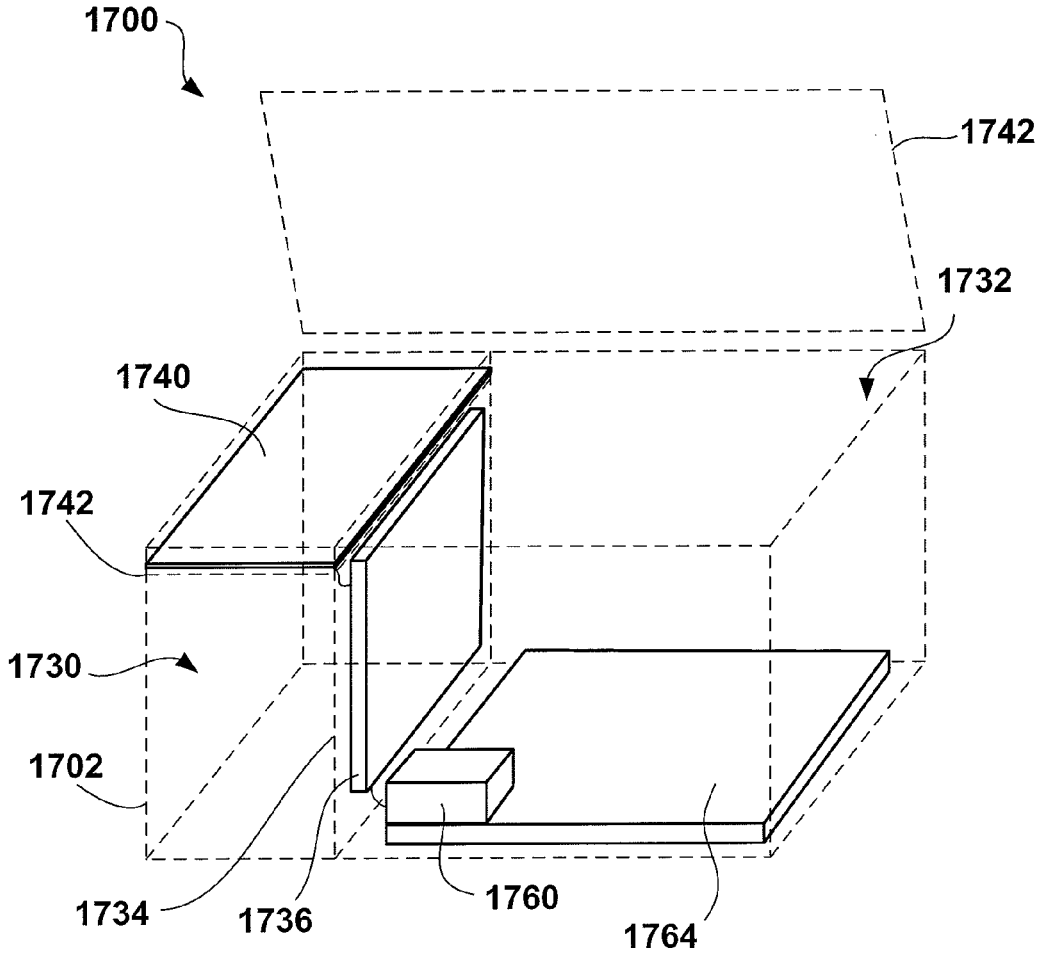
FIG. 17 is a perspective view illustrating one exemplary heated construction box with a hot plate in accord with one embodiment.

FIG. 17 is a perspective view illustrating one exemplary system 1700 including a construction box 1702 having a cooled compartment 1730, a heated compartment 1732 and a hot plate 1740. As discussed with reference to FIG. 16, cooled compartment 1730 and heated compartment 1732 are separated by a wall 1734, and a heat exchange device 1736 may receive power from an internal power source 1764, or integrated unit (e.g., integrated unit 650, FIGS. 6B and 6C), that is optionally coupled with a power converter 1760. Hot plate 1740 conductively transfers heat to an object in contact with the hot plate, e.g., caulk, epoxy, paint, lacquer, sealant, tar and the like, or food. As shown, hot plate 1740 is separated from cooled compartment 1730 by an insulated layer 1742. Hot plate 1740 may receive power from an external power source (not shown), or from internal power source 1764, or an integrated unit (e.g., integrated unit 650, FIGS. 6B and 6C), that is optionally coupled with power converter 1760.

Figure 18:
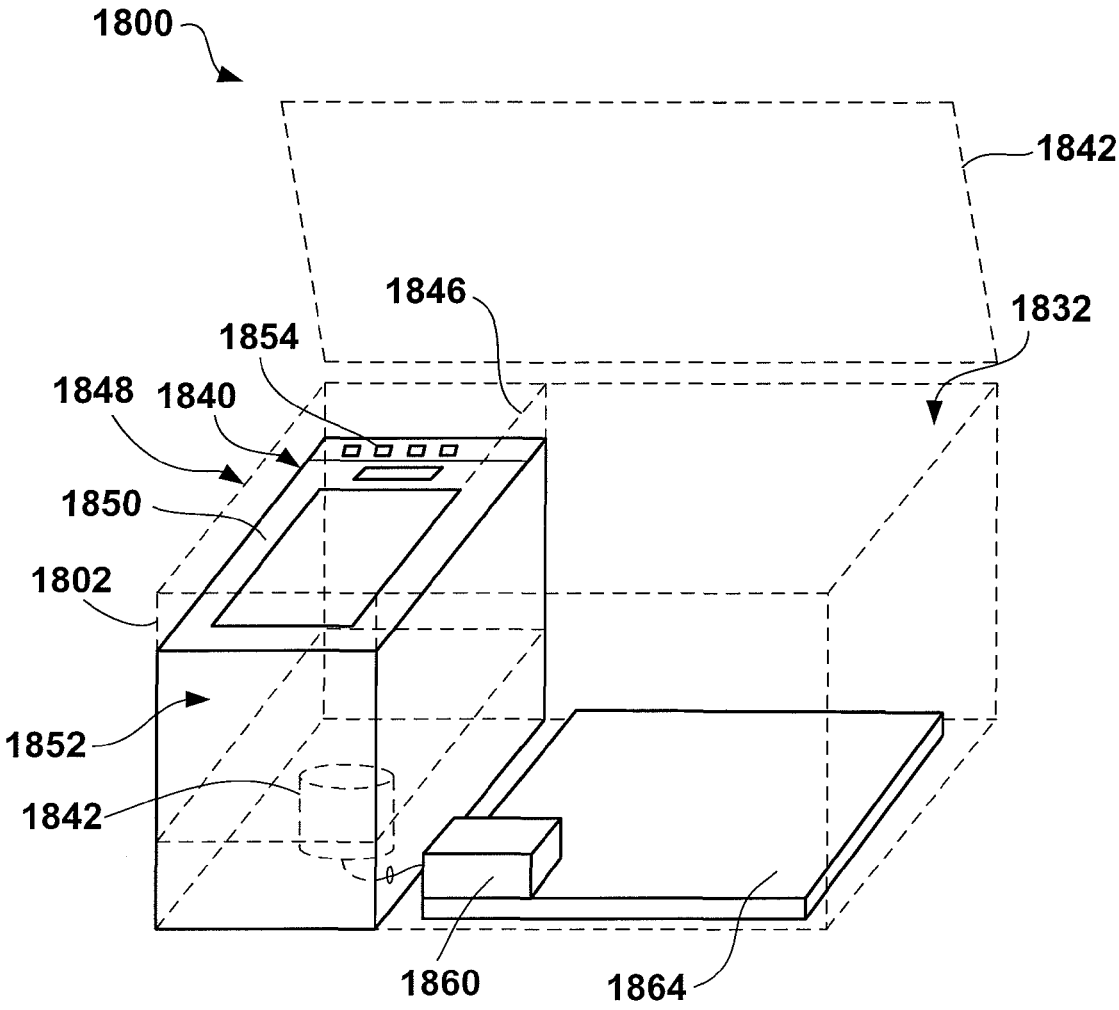
FIG. 18 is a perspective view illustrating one exemplary heated construction box with a microwave oven in accord with one embodiment.

FIG. 18 is a perspective view illustrating one exemplary system 1800 including a construction box 1802 with a microwave oven 1840. Microwave oven 1840 may be used to heat caulk, epoxy, paint, lacquer, sealant, tar and the like, or food. Microwave oven 1840 may be a self-contained device that is placed in compartment 1848, or it may be manufactured as part of construction box 1802. When microwave oven 1840 is manufactured as part of construction box 1802, the walls, lid and floor of box 1802 are formed of a material that is impenetrable to microwave radiation produced by microwave generator 1842. Microwave oven 1840 includes a door 1850, that allows access to a cooking compartment 1852, and a user interface 1854 for inputting desired cooking parameters. Microwave oven 1840 may receive power from an external power source (not shown), or from internal power source 1864, or an integrated unit (e.g., integrated unit 650, FIGS. 6B and 6C), that is optionally coupled with power converter 1860.

Construction boxes 1402, 1502, 1602, 1702 and 1802 may include thermostatic controllers such that heat is generated to maintain a user preset temperature within the construction boxes. Power outlets (not shown), which may be disposed on internal and/or external surfaces of the construction boxes, may be used to provide power to hand tools. Construction boxes 1402, 1502, 1602, 1702 and 1802 may contain their own power sources or they may utilize power from external sources, such as vehicles or residences.

Changes may be made in the above methods and systems without departing from the scope hereof. For example, construction boxes 202, 302, 402, 502, 602, 800, 820, 840, 860 and 880 may each optionally include one or more heaters 204, 304, 404, 504, 604, 802, 804, 822, 842, 844, 862, 864 and 882, zero, one or more power outlets 552, 562, 806, 824, 846 and 866, zero, one or more power converters 560, zero, one or more temperature controllers 520 and 620, zero, one or more heated seats and zero, one or more internal power sources 606, 806 and 826, without departing from the scope hereof. In another example, construction boxes 202, 302, 402, 502, 602, 800, 820, 840, 860 and 880 may be molded from rubber or plastic. In yet another example, one or more of heaters 204, 304, 404, 504, 604, 802, 804, 822, 842, 844, 862, 864, 882, controllers 220, 320, 420, 470, 520, 620, connectors 109, 209, 309, 409, 509, power outlets 552, 562, 806, 842, 846, 866, power converters 560 and/or power sources 606, 826 may be encapsulated during molding of the construction box. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A heated construction box system, comprising:
- a construction box;
- a heater for generating heat within the construction box when connected to a power source;
- a retractable power cord assembly for facilitating a transfer of power from the construction box to an external device electrically connected to a cord of the retractable power cord assembly;
- a relative humidity sensor;
- a controller responsive to the relative humidity sensor to maintain a set minimum relative humidity within the construction box; and
- a dehumidifier responsive to the controller to reduce humidity within the construction box.

2. The system of claim 1, the heater comprising a thermostatic control.

3. The system of claim 1, further comprising a temperature sensor, a user control and a controller responsive to the temperature sensor to maintain a set minimum temperature within the construction box.

4. A heated construction box system, comprising:
- a construction box;
- a heater for generating heat within the construction box when connected to a power source;
- a retractable power cord assembly for facilitating a transfer of power from the construction box to an external device electrically connected to a cord of the retractable power cord assembly;
- a plurality of adjoining walls;
- a base;
- a lid, the lid being hinged to one or more of the plurality of adjoining walls to provide access to the construction box; and
- an ultraviolet lamp for providing radiation to sterilize objects within the construction box.

5. The system of claim 4, the heater comprising a thermostatic control.

6. The system of claim 4, further comprising a temperature sensor, a user control and a controller responsive to the temperature sensor to maintain a set minimum temperature within the construction box.

* * * * *